US008249473B2

(12) United States Patent
Maruyama

(10) Patent No.: US 8,249,473 B2
(45) Date of Patent: Aug. 21, 2012

(54) IMAGE FORMING APPARATUS WITH REDUCED DETERIORATION OF THE CARRIER CARRYING DEVELOPER

(75) Inventor: Tsuyoshi Maruyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 427 days.

(21) Appl. No.: 12/606,270

(22) Filed: Oct. 27, 2009

(65) Prior Publication Data

US 2010/0111557 A1 May 6, 2010

(30) Foreign Application Priority Data

Oct. 30, 2008 (JP) ..... 2008-279844

(51) Int. Cl.
*G03G 15/00* (2006.01)
*G03G 15/16* (2006.01)
*G03G 21/00* (2006.01)

(52) U.S. Cl. ..... 399/38; 399/66; 399/71

(58) Field of Classification Search ..... 399/38, 399/66, 71, 101
See application file for complete search history.

(56) References Cited

U.S. PATENT DOCUMENTS 7,865,097 B2 * 1/2011 Ishikawa ..... 399/101

FOREIGN PATENT DOCUMENTS

| | | |
|---|---|---|
| JP | 2001-051518 A | 2/2001 |
| JP | 2002-055545 A | 2/2002 |
| JP | 2006-259235 A | 9/2006 |

OTHER PUBLICATIONS

Japan Patent Office; Notification of Reasons for Refusal in Japanese Patent Application No. 2008-279844 (counterpart to the above-captioned US Patent Application) mailed on Jul. 8, 2010.

* cited by examiner

*Primary Examiner* — William J Royer
(74) *Attorney, Agent, or Firm* — Baker Botts L.L.P.

(57) ABSTRACT

An image forming apparatus includes: a carrier configured to carry developer; a voltage applying unit configured to apply a voltage to the carrier so that a carrier current flows from the voltage applying unit through the carrier; and a current detecting unit configured to detect the carrier current. The current detecting unit detects the carrier current at an uncharged portion of the carrier.

12 Claims, 8 Drawing Sheets

IMAGE FORMING APPARATUS WITH REDUCED DETERIORATION OF THE CARRIER CARRYING DEVELOPER

CROSS REFERENCE TO RELATED APPLICATION

This application claims priority from Japanese Patent Application No. 2008-279844 filed on Oct. 30, 2008. The entire content of this priority application is incorporated herein by reference.

TECHNICAL FIELD

The present invention relates to an image forming apparatus and, in particular, reduction of deterioration of a conveying belt thereof.

BACKGROUND

In order to perform a suitable image forming operation, an art for a conventional image forming apparatus to supply current to a conveying belt with a cleaning roller and detect the resistance of the conveying belt is known. Furthermore, because the conveying belt can be damaged or deteriorated if a voltage applying unit supplies too much current to the conveying belt, an art to detect the current (the resistance) flowing through the conveying belt and control the current is also known.

However, with an image forming apparatus using the art, the conveying belt has a portion charged by a transfer bias applied thereto, and detection of the current can be performed at the charged portion. Then, a current generated by the charge can be contained in the detected current, and the accuracy in detection of the current can be lower.

Therefore, there is a need for an image forming apparatus that has higher accuracy in detection of the current flowing through a carrier such as the conveying belt.

SUMMARY

An aspect of the present invention is an image forming apparatus including: a carrier configured to carry developer; a voltage applying unit configured to apply a voltage to the carrier so that a carrier current flows from the voltage applying unit through the carrier; and a current detecting unit configured to detect the carrier current. The current detecting unit detects the carrier current at an uncharged portion of the carrier.

DETAILED DESCRIPTION

<First Illustrative Aspect>

A first illustrative aspect according to the present invention will be described with reference to FIGS. 1 through 6.

1. Schematic Configuration of Printer

Figure 1:
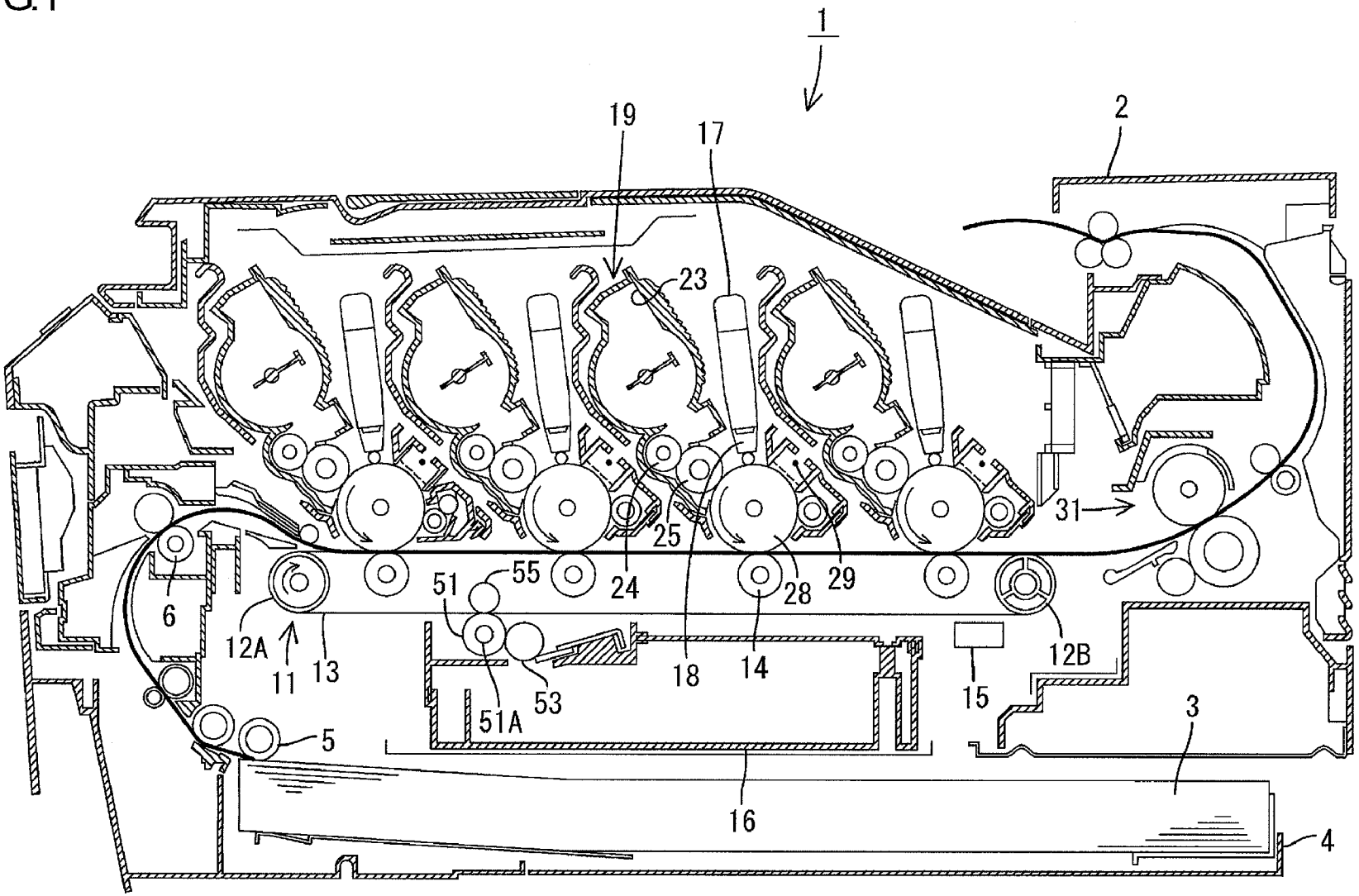
FIG. 1 is a schematic sectional view illustrating an inner configuration of a printer of a first illustrative aspect according to the present invention.

As illustrated in FIG. 1, a printer 1 (an image forming apparatus) of this illustrative aspect is a color printer of a direct transfer type (a transfer belt type). The printer 1 forms a color image using toner T (developer) in four colors (black K, yellow Y, magenta M, and cyan C). In the description as below, where these elements are described distinctively by color, their reference characters will have additional characters of Y (yellow), M (magenta), C (cyan), and K (black) on the end; where they are described indistinctively by color, these additional characters will be omitted.

The printer 1 includes a casing 2 and a sheet supply tray 4 disposed in a bottom portion in the casing 2 such that a plurality of sheets 3 (recording media; specifically, paper sheets) can be stacked therein. A sheet supply roller 5 is disposed above the front end of the sheet supply tray 4. As the sheet supply roller 5 rotates, a sheet 3 stacked uppermost in the sheet supply tray 4 is sent out toward a registration roller 6. The registration roller 6 corrects skew of the sheet 3 and, thereafter, conveys the sheet 3 onto a belt unit 11.

The belt unit 11 has two support rollers 12A, 12B and a loop conveying belt 13 (a carrier) stretched between the support rollers 12A, 12B. The conveying belt 13 (hereinafter referred to simply as the belt) is made of resin such as polycarbonate and has a mirror finished surface. The rear support roller 12B rotates and circulates the belt 13 so that the belt 13 conveys the sheet 3 carrying thereon backwardly (toward the right hand in FIG. 1). Four transfer rollers 14 are disposed in the loop of the belt 13 and at positions opposed to photosensitive bodies 28 of process units 19K-19C (described below) across the belt 13.

Furthermore, a cleaning unit 16 (a voltage applying unit, a cleaning unit, and a charge removing unit) is disposed below the belt unit 11. The cleaning unit 16 collects the toner T, paper powder, and the like that are clinging to the outer surface of the belt 13. The cleaning unit 16 has a cleaning roller 51, a cleaning shaft 53, and a backup roller 55. The cleaning roller 51 has a shaft 51A extending in the widthwise direction of the belt 13 and a foamed material such as silicon around the circumference of the shaft 51A. The backup roller 55 is made of metal and is disposed in a manner opposed to the cleaning roller 51 across the belt 13. The backup roller 55 is grounded (in particular, via a resistor R5 (see FIG. 2)).

The cleaning roller 51 contacts the belt 13 while rotating in a manner moving at the contacting portion in a direction opposite from the direction in which the belt 13 moves. Then, when a first cleaning voltage BCLN1 of, for example, −1200 V (a voltage having the polarity opposite from the polarity of the toner T) is applied to the cleaning roller 51, the toner T clinging to the belt 13 is electrically adsorbed to the cleaning roller 51. The surface of the belt 13 is thus cleaned.

Furthermore, the cleaning shaft 53 is a metal and is in contact with the cleaning roller 51. When a second cleaning voltage BCLN2 of, for example, −1600V (having an absolute value larger than the absolute value of the first cleaning voltage BCLN1) is applied to the cleaning shaft 53, the toner T clinging to the cleaning roller 51 is electrically adsorbed to the cleaning shaft 53. The toner T is thus collected.

Four exposure units 17 and the four process units 19 are arranged in tandem (in the right-left direction in FIG. 1) above the belt unit 11. Each of the exposure units 17 includes a LED head 18 having a plurality of LEDs arranged in line. Light emission from the exposure units 17 is controlled on a basis of a forming image data so that the surfaces of the respective opposed photosensitive bodies 28 are exposed to the light emitted from the LED heads 18 line by line.

Each of the process units 19 includes a toner chamber 23 and, below the toner chamber 23, a supply roller 24, a developer roller 25, and the like. The toner chambers 23 store the toner T in the respective colors. Toner T released from the toner chambers 23 is supplied to the respective developer rollers 25 by rotation of the respective supply rollers 24. Then, the toner T is positively charged by friction between the supply rollers 24 and the developer rollers 25.

Furthermore, each of the process units 19 has the photosensitive body 28 and a charger 29 of a scorotron type. The photosensitive body 28 has a surface covered by a photosensitive layer having a positive charge property. At a time of an image forming operation, the photosensitive bodies 28 rotate, and, accompanying this, the surfaces of the photosensitive bodies 28 are uniformly and positively charged. Thereafter, the positively charged portions are exposed by the exposure units 17. Electrostatic latent images are thus formed on the surfaces of the photosensitive bodies 28.

Next, the toner T carried on the developer rollers 25 and positively charged is supplied to the electrostatic latent images on the surfaces of the photosensitive bodies 28 under developer biases. Thereafter, while the sheet 3 is passing transfer positions between the photosensitive bodies 28 and the transfer rollers 14, the toner images carried on the surfaces of the photosensitive bodies 28 are transferred onto the sheet 3 one by one with negative transfer voltages TR applied to the transfer rollers 14. The sheet 3 carrying the toner images transferred thereon is, next, conveyed to a fixing unit 31. The toner images are fused there. Thereafter, the sheet 3 is conveyed upwardly and is ejected onto the casing 2.

Furthermore, a high-voltage control unit 15 is disposed below, for example, the conveying belt 13.

2. Configuration of High-Voltage Control Unit

The high-voltage control unit 15 generates the voltages to be applied to the electric loads included in the printer 1. The electric loads include the transfer rollers 14, the developer rollers 25, the chargers 29, the cleaning unit 16, and the like.

Figure 2:
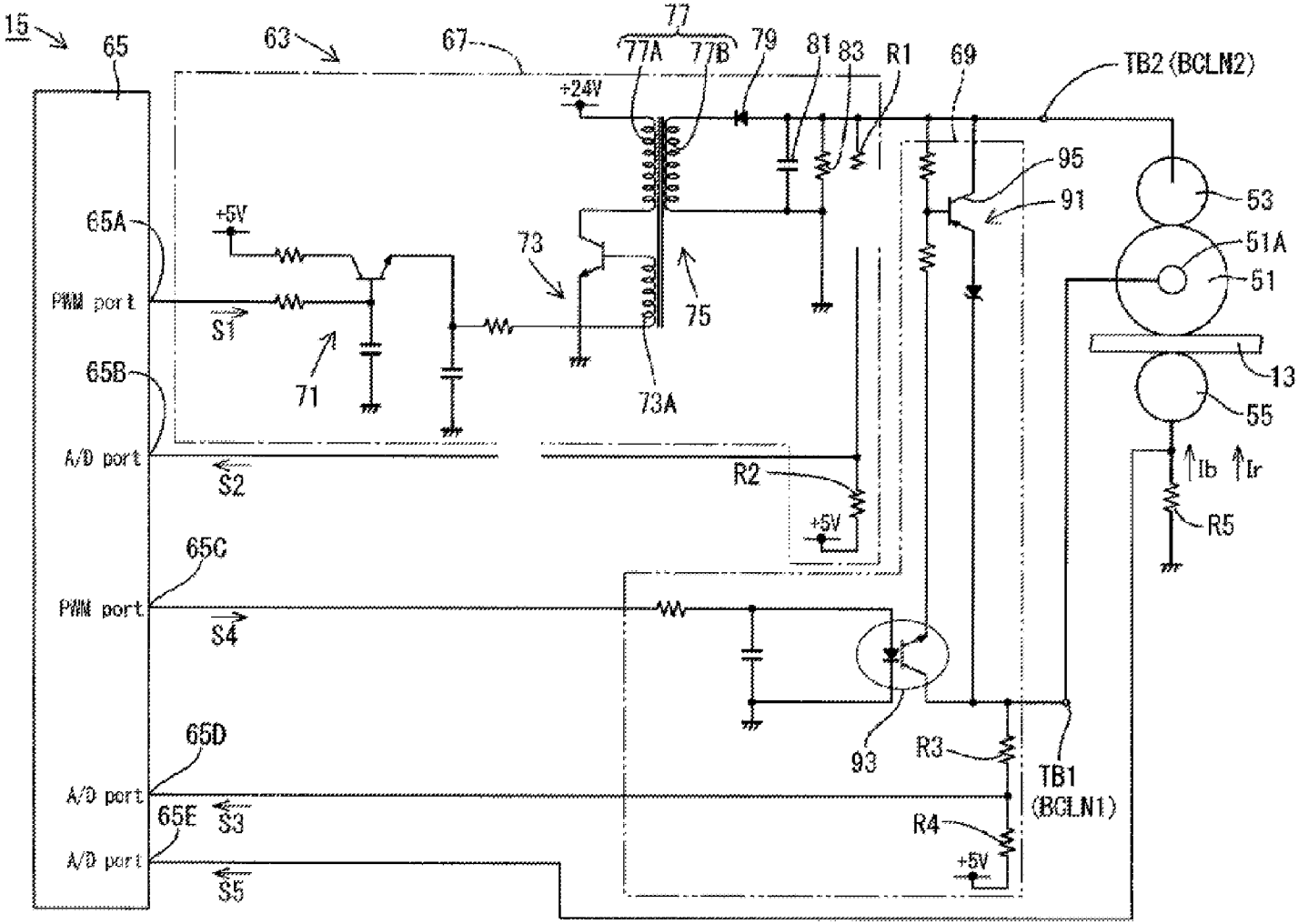
FIG. 2 is a diagram of a configuration of a part that generates voltages to be applied to a cleaning unit.

As illustrated in FIG. 2, the high-voltage control unit 15 has a configuration for generating the voltages (the first cleaning voltage BCLN1 and the second cleaning voltage BCLN2) to be applied to the cleaning unit 16. The high-voltage control unit 15 has a high-voltage circuit 63 and a control circuit 65 (a current detecting unit and a determining unit). Note that the control circuit 65 may be a circuit having a built-in CPU or may be configured as an application specific integrated circuit (ASIC). Note also that the control circuit 65 performs not only the high-voltage control but also various kinds of print control of the printer 1.

The high-voltage circuit 63 of this illustrative aspect is, for example, a two-output circuit adopting a shunt system. The high-voltage circuit 63 generates the first cleaning voltage BCLN1 and the second cleaning voltage BCLN2 and outputs them. The high-voltage circuit 63 mainly has a high-voltage generating circuit 67 and a shunt circuit 69.

The high-voltage generating circuit 67 is a power circuit that generates the second cleaning voltage BCLN2 to be applied to the cleaning shaft 53. The high-voltage generating circuit 67 has a PWM (Pulse Width Modulation)-signal smoothing circuit 71, a transformer driving circuit 73, a voltage step-up and smoothing rectifier circuit 75, and the like. The PWM-signal smoothing circuit 71 receives a PWM signal Si from a PWM port 65A of the control circuit 65 and smoothes it. The transformer driving circuit 73 is controlled by the smoothed PWM signal Sl. The transformer driving circuit 73 has a self-excitation winding 73A and, corresponding to the smoothed PWM signal Sl, supplies the excited current to a primary winding 77A of the voltage step-up and smoothing rectifier circuit 75.

The voltage step-up and smoothing rectifier circuit 75 has a transformer 77, a diode 79, a smoothing capacitor 81, and the like. An end of a secondary winding 77B of the transformer 77 is connected to the cleaning shaft 53 via the diode 79 and via a second output terminal TB2. In addition, the smoothing capacitor 81 and a discharge resistance 83 are connected in parallel with each other to the secondary winding 77B. With this configuration, the excited voltage in the primary winding 77A is stepped up and rectified in the voltage step-up and smoothing rectifier circuit 75 and is applied to the cleaning shaft 53 as the second cleaning voltage BCLN2.

Furthermore, the high-voltage generating circuit 67 has feedback resistances R1, R2 for detecting the second cleaning voltage BCLN2, and a detection signal S2 corresponding to this divided voltage is supplied to an A/D port 65B of the control circuit 65. The control circuit 65 executes constant voltage control by suitably changing the duty ratio of the PWM signal S1 on a basis of the detection signal S2 so that the second cleaning voltage BCLN2 is at an objected level. Note that the feedback resistance R2 is connected to a positive potential line (of +5 [V] in this illustrative aspect) so that a negative voltage is not applied to the A/D port 65B.

Note that the high voltages such as the transfer voltages TR to be applied to the transfer rollers 14 are also generated with a configuration similar to the high-voltage generating circuit 67.

The shunt circuit 69 generates the first cleaning voltage BCLN1 to be applied to the cleaning roller 51 on a basis of the second cleaning voltage BCLN2. The shunt circuit 69 mainly has a current control circuit 91 and a photocoupler 93.

The current control circuit 91 has a transistor 95 as a current regulating element. A first output terminal TB1 is electrically connected to the cleaning roller 51, and the transistor 95 is connected between the first output terminal TB1 and the second output terminal TB2. Corresponding to an on-state current of the photocoupler 93, the on-state resistance of the transistor 95 is varied, and the first cleaning voltage BCLN1 is varied. Specifically, corresponding to a PWM signal S4 outputted from a PWM port 65C of the control circuit 65, the base potential of the transistor 95 is changed.

Furthermore, the first output terminal TB1 is provided with feedback resistances R3, R4 for detecting the first cleaning voltage BCLN1, and a detection signal S3 corresponding to this divided voltage is supplied to an A/D port 65D of the control circuit 65. Note that the feedback resistance R4 is, similar to the resistance R2, connected to the positive potential line (of +5 [V] in this illustrative aspect). The control circuit 65 executes constant voltage control by suitably changing the duty ratio of the PWM signal S4 on a basis of the detection signal S3 so that the first cleaning voltage BCLN1 is at an objected level.

Furthermore, a current detection resistance R5 (a current detecting unit) is provided between the backup roller 55 and the ground, and a detection signal S5 corresponding to the terminal voltage of the current detection resistance R5 is supplied to an A/D port 65E of the control circuit 65. The control circuit 65 detects a belt current Ib and an inflow current Ir using the current detection resistance R5. The belt current Ib flows through the belt 13 while the first cleaning voltage BCLN1 is being applied to the belt 13. The inflow current Ir flows from the belt 13 to the cleaning unit 16 while the first cleaning voltage BCLN1 is not being applied to the belt 13. That is, the belt current Ib and the inflow current Ir are calculated from the value of the current detection resistance R5 and the detection signal S5 (the voltage value), which are already known, by Ohm's law. Note that the direction of the inflow current Ir depends on the polarity of the charge carried on the belt 13 and is not necessarily limited to the direction illustrated by the arrow in FIG. 2.

3. Belt-Current Detection Process

Next, the belt-current detection process of the first illustrative aspect will be described with reference to FIGS. 3 through 6. The belt-current detection process is executed by the control circuit 65 in accordance with a predetermined program.

Note that detection of the belt current Ib in the first illustrative aspect is performed after the transfer rollers 14 terminate applying the transfer voltages TR and, further, after a predetermined time elapses. That is, in the first illustrative aspect, the determination whether the opposed portion of the belt 13 to the cleaning roller 51 (the cleaning unit) is an uncharged portion is made on a basis of whether the predetermined time has elapsed after applying of the transfer voltages is terminated. Measurement of time in this case is, for example, performed using a timer (not illustrated) provided in the control circuit 65.

Figure 3:
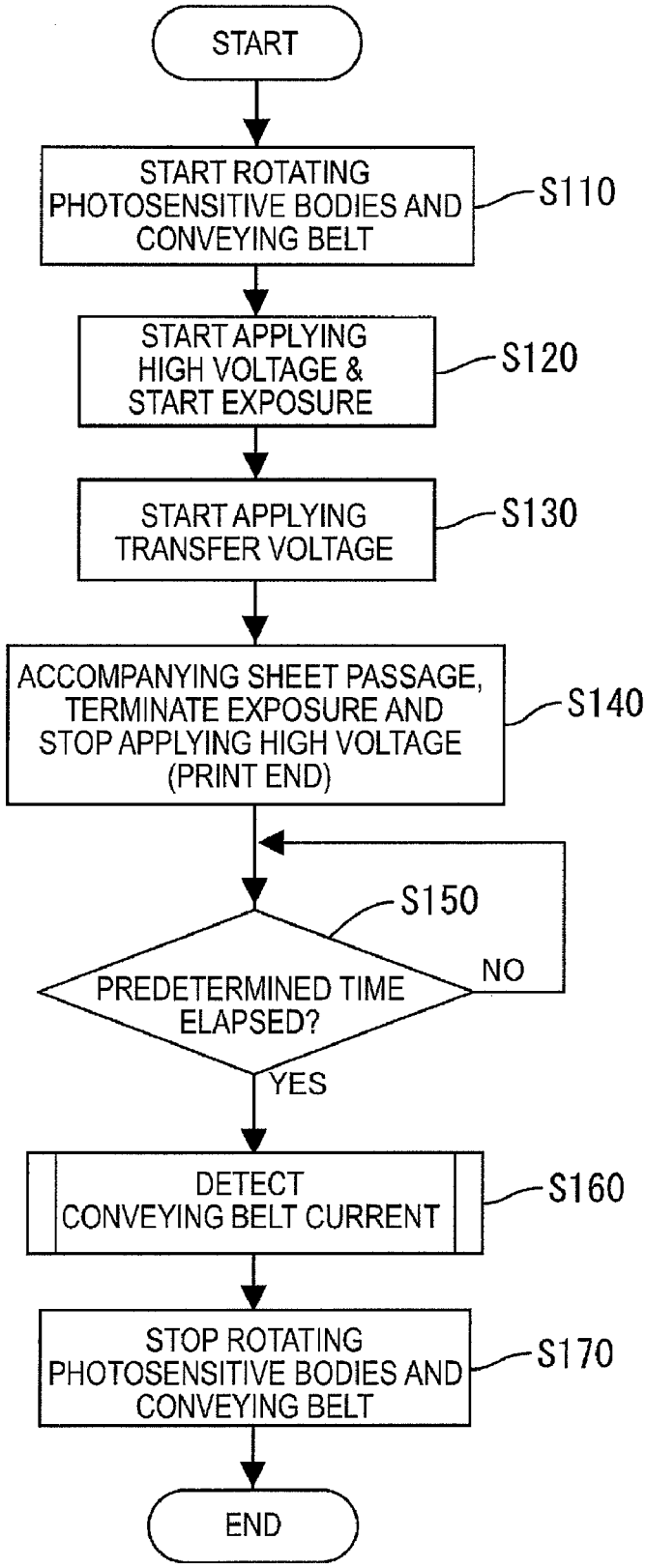
FIG. 3 is a flowchart illustrating a belt-current detection process.

When the printer 1 has received a print instruction, the control circuit 65, first, in step S110 in FIG. 3, controls a predetermined rotating mechanism to start rotating the photosensitive bodies 28 and the belt 13. Next, in step S 120, the control circuit 65 generates high voltages such as charging voltages, the developing biases, and the belt cleaning voltage BCLN and applies them to the chargers 29, the developer rollers 25, and the cleaning roller 51, respectively. Furthermore, the control circuit 65 starts exposing the photosensitive bodies 28 using the exposure units 17 at predetermined timings.

Next, in step S130, the control circuit 65 applies the transfer voltages TR to the respective transfer rollers 14 at predetermined timings. Suppose here that the belt-cleaning voltages BCLN1, BCLN2 are applied at a time point t0 in FIG. 4. Thereafter, the transfer voltages TR_K, TR_Y, TR_M, TR_C are applied sequentially to respective transfer rollers 14K, 14Y, 14M, 14C, as illustrated in FIG. 4, so that the voltage-applied area on the belt 13 is identical with respect to all colors.

That is, corresponding to movement of the conveying belt 13 and during the transfer period to transfer the toner T of each color to the sheet 3, the transfer voltages TR_K, TR_Y, TR_M, TR_C are applied to the belt 13. Accordingly, the charged portion of the conveying belt 13 can be unbroadened. As a result of this, the belt 13 can have a broader area where the belt current Ib is detectable. Furthermore, the charge removing time can be shorter.

Figure 4:
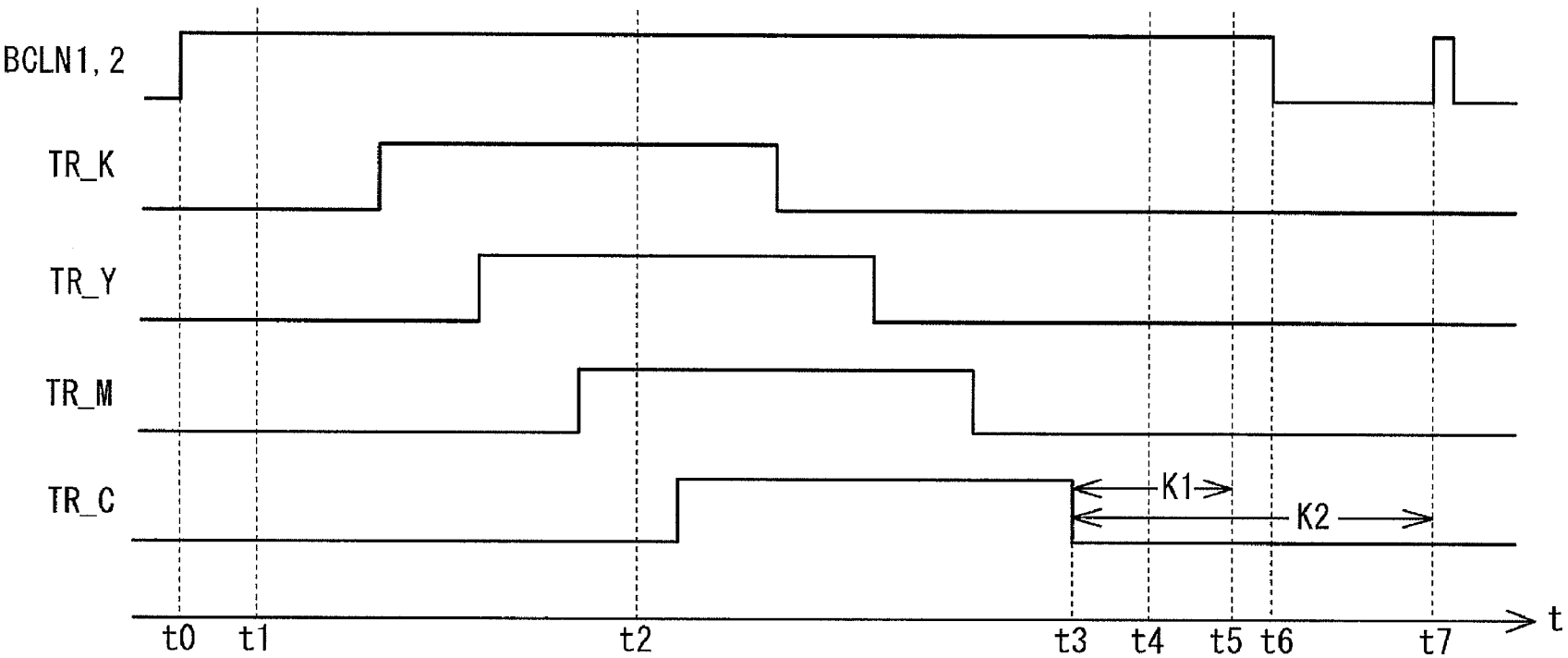
FIG. 4 is a schematic time chart of the belt-current detection process.
Figure 5:
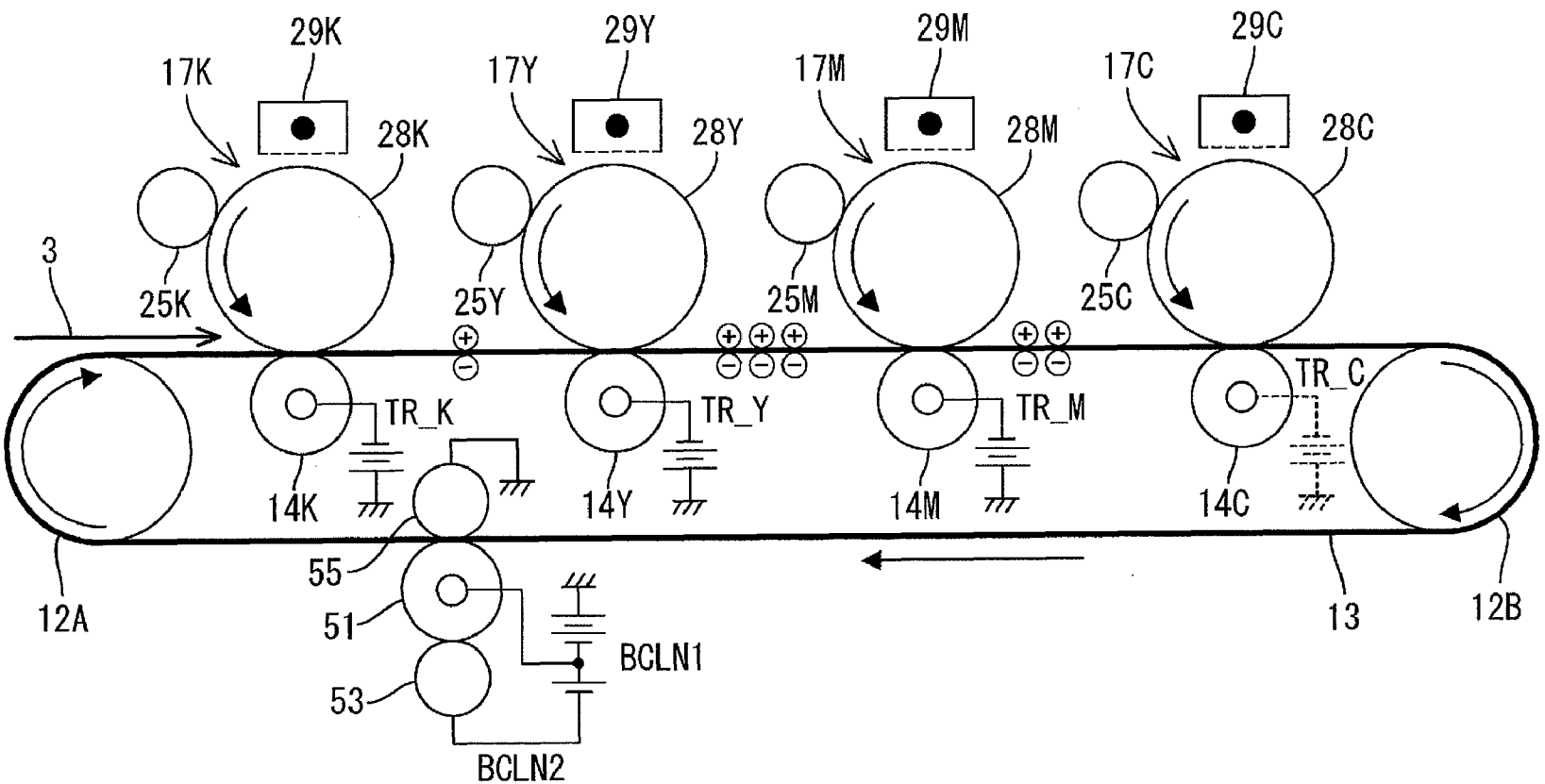
FIG. 5 is an explanatory view schematically illustrating a charged state of a conveying belt.

Note that the charged state of the belt 13 at a time point t2 in FIG. 4 is illustrated in FIG. 5. As described above, in the first illustrative aspect, the toner T is positively charged, while the negative transfer voltages TR are applied to the transfer rollers 14. By this, the outer surface and the inner surface of the belt 13 are charged so that the outer surface of the belt 13 is positively charged and the inner surface of the belt 13 is negatively charged, as illustrated in FIG. 5. Note that the positive charge of the toner T (positively charged) remaining on the photosensitive bodies 28 is also carried on the outer surface of the belt 13.

Note that it is hereinafter considered such that, in a case where a voltage is applied to the belt 13, the belt 13 is equal to a capacitor, so that the belt 13 is charged (electrified) by charging with the applied voltage, while charge is removed from the belt 13 by discharging with the voltage applied thereto. That is, it is considered that the belt 13 is charged (electrified) by charging and that charge is removed from the belt 13 by discharging.

Next, in step S140, accompanying passage of the sheet 3 under the photosensitive body 28C, exposure is terminated, and applying of the high voltages such as the charging voltages and the developing biases are stopped. That is, printing is terminated. Next, in step S150, the control circuit 65 (the determining unit) determines whether the certain time K1 (the predetermined time) has elapsed. Note here that the certain time K1 is, as illustrated in FIG. 4, a time from a time point t3 to a time point t5. The time point t3 is a time point where the transfer roller 14C stops applying the transfer voltage TR_C. The time point t5 is a time point where an uncharged portion 13A of the belt 13 opposed to the transfer roller 14C at the time point t3 passes a position opposed to the cleaning roller 51. The certain time K1 is set in advance on a basis of the moving speed of the belt 13. The certain time K1 is counted using the above-described timer.

Figure 6:
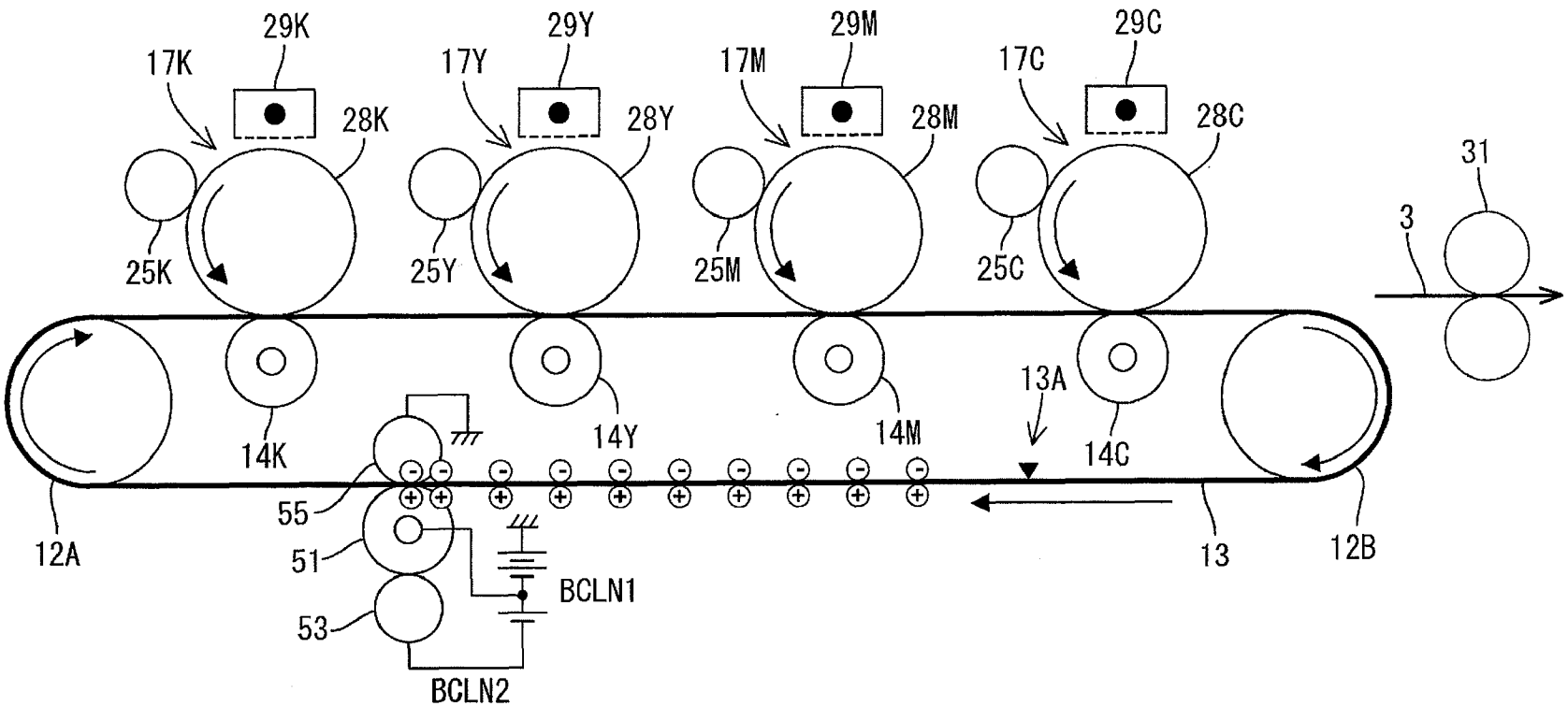
FIG. 6 is an explanatory view schematically illustrating another charged state of the conveying belt.

If it is determined in step S150 that the certain time K1 has not elapsed yet, the determination of the step S150 is repeated. The charged state of the belt 13 at a time point t4 is illustrated in FIG. 6 as an illustration of this case. As illustrated in FIG. 6, the charged portion of the belt 13 has reached the cleaning roller 51. Note that, if detection of the belt current Ib is performed in this case, a current including the inflow current Ir due to the charge of the belt 13 has to be detected by the current detection resistor R5.

On the other hand, if it is determined in the step S150 that the certain time K1 has elapsed, the process goes to step S160 so that the control circuit 65 (the current detecting unit) detects the belt current Ib. In this case, because the first cleaning voltage BCLN1 can be utilized as it is as a current detection voltage, the control circuit 65 simply receives the detection signal S5 (the voltage value) by the current detection resistor R5 and, on a basis of the resistance value of the current detection resistor R5 and the detection signal S5, detects (calculates) the belt current Ib.

Next, in step S170, rotation of the photosensitive bodies 28 and the belt 13 are stopped, and this process is terminated.

As above, in the first illustrative aspect, the belt current Ib is detected when the certain time K1 has elapsed from the time point where applying of the voltage TR _C is stopped (the time point t3 in FIG. 4) and when the uncharged portion 13A (see FIG. 6) of the belt 13 passes the opposed position to the cleaning roller 51 (the time point t5 in FIG. 4). That is, the first cleaning voltage BCLN1 is applied to the uncharged portion 13A of the belt 13 so that the belt current Ib is detected. Accordingly, because the influence of the charge of the belt 13 can be eliminated, the accuracy in detection of the current flowing through the belt 13 can be improved. As a result of this, the first cleaning voltage BCLN1 to be applied to the belt 13 can be kept at a proper level, and deterioration of the belt 13 can be reduced.

Note that detection of the belt current Ib is executed not necessarily while the first cleaning voltage BCLN1 is being applied for print processing (during image forming operation). For example, the certain time may be, as illustrated in FIG. 4, a time K2 that is from the time point t3 to a time point t7 where image forming operation has been terminated. In this case, though it is required to stop the first cleaning voltage BCLN1 for a time and, thereafter, to generate the first cleaning voltage BCLN1 again as the current detection voltage, variable setting for the voltage value of the current detection voltage can be suitably made corresponding to conditions.

<Second Illustrative Aspect>

Next, a belt-current detection process of a second illustrative aspect will be described with reference to FIG. 7. While detection of the belt current Ib of the first illustrative aspect is performed accompanying the print processing, detection of the belt current Ib of the second illustrative aspect does not necessarily accompany the print processing. In the second illustrative aspect, the belt current Ib is detected if the inflow current Ir into the cleaning unit 16 due to the charge of the belt 13 is equal to or less than a predetermined value. That is, in the second illustrative aspect, determination whether the opposed portion of the belt 13 to the cleaning roller 51 (the cleaning unit) is the uncharged portion is made on a basis of whether the inflow current Ir is equal to or less than the predetermined value. Note that the second illustrative aspect is identical with the first illustrative aspect in the hardware configuration, while differs only in the belt-current detection processes. Therefore, description of the configuration identical with the first illustrative aspect will be omitted.

Figure 7:
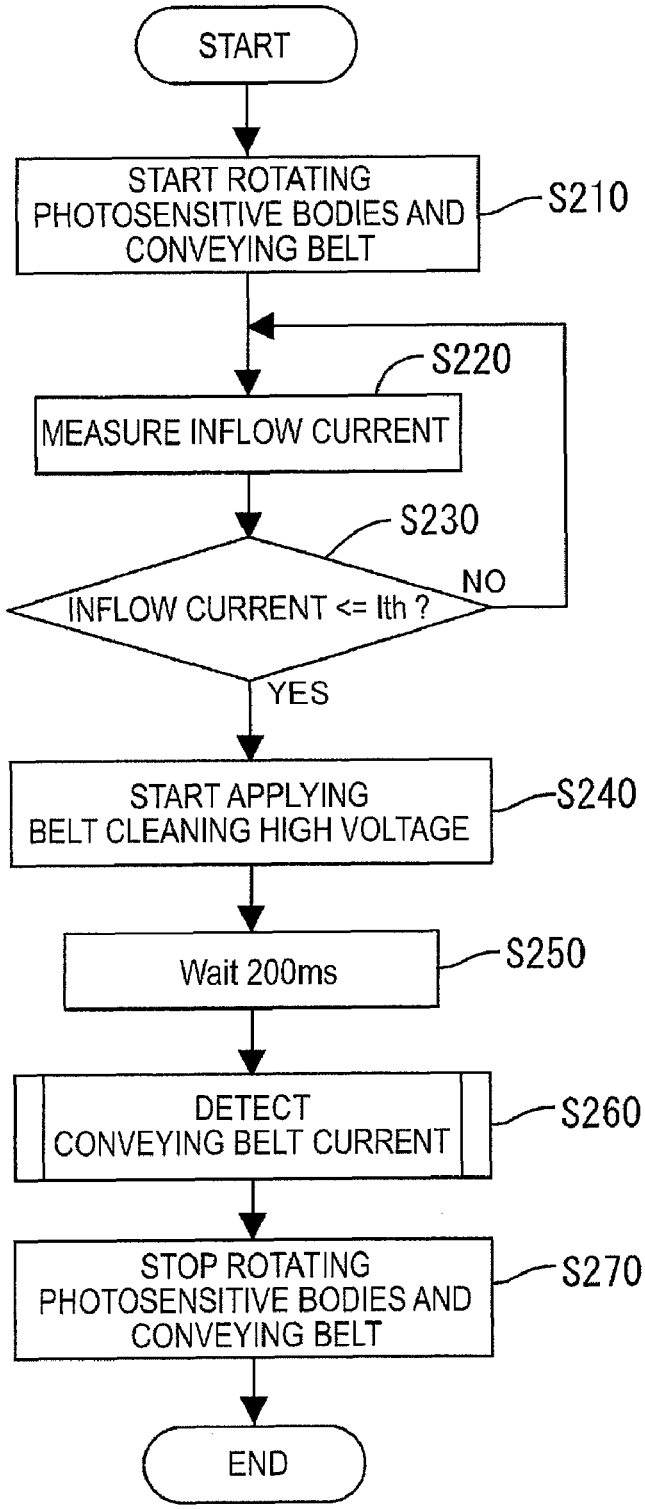
FIG. 7 is a schematic flowchart of the belt-current detection process of a second illustrative aspect.

The belt-current detection process illustrated in FIG. 7 is executed when, for example, the printer 1 is powered on or is returned from a sleep mode. The belt-current detection process may be executed also at a time point t1 illustrated in FIG. 4 or after elapse of a predetermined time from a time point t6 where the belt cleaning voltages BCLN are stopped.

In step S210 in FIG. 7, the control circuit 65 controls the rotating mechanism to start rotating the photosensitive bodies 28 and the belt 13. Thereafter, in step S220, the control circuit 65 measures the inflow current Ir into the cleaning unit 16 due to the charge carried on the belt 13. Measurement of the inflow current Ir is performed on a basis of, for example, similar to detection of the belt current Ib, the detection signal S5 (the voltage value) and the resistance value of the current detection resistor R5. Note that the belt cleaning voltages BCLN are neither generated nor applied at that time.

Next, in step 230, the control circuit 65 (the determining unit) determines whether the measured inflow current Ir is equal to or less than a predetermined value Ith. If the inflow current is determined to be neither equal to nor less than the predetermined value Ith, the process returns to the step S220 so that the process of measuring the inflow current Ir of the step S220 is repeated. Note that the predetermined value Ith is decided in advance by experiments as a value that does not affect the accuracy in detection of the belt current Ib.

On the other hand, if the inflow current Ir is determined to be equal to or less than the predetermined value Ith in the step S230, the process goes to step S240 so that the control circuit 65 starts applying the belt cleaning voltages BCLN. Then, in step S250, the control circuit 65 waits for a predetermined time (e.g. 200 ms) until the belt cleaning voltages BCLN rise up to a stabilized state. Next, in step S260, the control circuit 65 detects the belt current Ib in a same manner as in the step S160 in FIG. 6 of the first illustrative aspect. Thereafter, in step S270, the control circuit 65 stops rotating the photosensitive bodies 28 and the belt 13 and terminates the present process.

As above, in the second illustrative aspect, the determination whether the opposed portion of the belt 13 to the cleaning roller 51 is the uncharged portion 13A is made simply on the basis of whether the inflow current Ir from the belt 13 into the cleaning unit 16 is equal to or less than the predetermined value Ith. Therefore, the inflow current Ir can be detected independently of the print processing. That is, in comparison with the first illustrative aspect, time can be spared for detecting the inflow current Ir. Therefore, detection of the inflow current Ir of the second illustrative aspect should be executed at the time when the printer 1 is powered on or is returned from the sleep mode, when the likelihood that the belt 13 is charged is less.

Note that, in a case where the inflow current Ir is detected after termination of the print processing, detection of the inflow current Ir equal to or less than the predetermined value Ith enables the belt current Ib to be detected as soon as the cleaning roller 51 and the uncharged portion 13A of the belt 13 are opposed to each other after the charged portion of the belt 13 passes the cleaning roller 51.

<Third Illustrative Aspect>

A charge removing unit may be further included in the first illustrative aspect or in the second illustrative aspect. The charge removing unit removes (discharges) charge from the charged portion of the belt 13 by the transfer rollers 14 (the transfer units) so that the portion becomes the uncharged portion 13A of the belt 13. With the charge removing unit, the current detectable portion of the belt 13 can still be broadened.

For example, the charge removing unit may be configured by the cleaning roller 51 so that the cleaning roller 51 applies a predetermined voltage to the belt 13. In this case, the cleaning roller 51 should remove charge from a charged portion of the belt 13 while applying the cleaning voltage thereto. Then, charge can be suitably removed from the belt 13 without providing any new charge removing unit. Furthermore, the cleaning roller 51 can perform cleaning and removing of charge. That is, where the toner T is positively charged, adsorption of the toner T from the belt 13 and adsorption (discharging) of the positive charge on the outer surface of the belt 13 can be performed using the negative cleaning voltages BCLN1 at the same time during a predetermined period.

Figure 8:
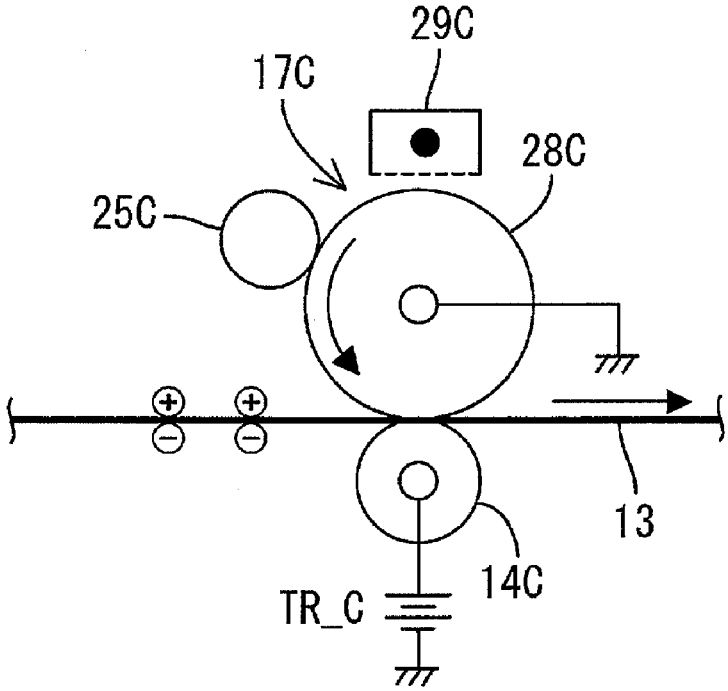
FIG. 8 is an explanatory view illustrating a configuration of a third illustrative aspect where a charge removing unit is configured by a transfer roller.

Furthermore, as illustrated in FIG. 8, the charge removing unit may be configured by the transfer rollers 14 (the transfer units). Note that, in this case, it is required for the transfer rollers 14 to apply voltages having the polarity opposite from the polarity of the transfer voltages TR to the belt 13 after termination of the transfer processing so that charge is removed from the charged portion of the belt 13 (so that the charged portion is discharged). Where the cleaning roller 51 removes charge from the belt 13 as described above, it is necessary to wait for a period until the charge-removed portion of the belt 13 circulates a circle and is opposed to the cleaning roller 51. Differently from this, in the case where the transfer roller 14 removes charge, it is only necessary to wait for the period until the charge-removed portion of the belt 13 by the transfer rollers 14C is opposed to the cleaning roller 51. Therefore, the time from charge removal from the belt 13 to detection of the belt current can be shortened.

Note that the determination whether the charge-removed portion (the uncharged portion 13A) of the belt 13 has reached to be opposed to the cleaning roller 51 may be performed on a basis of, for example, similar to the first illustrative aspect, elapse of a predetermined time or, similar to the second illustrative aspect, by detecting the inflow current Ir.

<Other Illustrative Aspects>

The present invention is not limited to the illustrative aspects described above with reference to the drawings; for example, the following illustrative aspects are also within the scope of the present invention.

(1) In the above-described illustrative aspect, the present invention is adopted to the image forming apparatus of the transfer belt type, and the conveying belt 13 is illustratively used as the carrier. The present invention is not limited to this. For example, the present invention may be adopted to an image forming apparatus of an intermediate transfer type. In this case, an intermediate transfer belt and the applying unit can be used as the carrier and the transfer unit, respectively. Then, because the influence of charge of the intermediate transfer belt can be eliminated, the accuracy in detection of the current flowing through the intermediate transfer belt can be improved. That is, it is only necessary for the carrier to carry developer, and the present invention can be adopted in a case where detection of the current flowing through the carrier is required.

(2) In the above-described illustrative aspect, the transfer rollers 14 and the cleaning unit 16 use the negative transfer voltages and the negative cleaning voltage. In a case where, for example, the toner T has a negative charge property, it is required for the transfer rollers 14 and the cleaning unit 16 to use positive transfer voltages and cleaning voltage. The present invention can be adopted also to such a configuration.

(3) The printer 1 of the above illustrative aspects is a multi-color printer having the toner T in a plurality of colors. The printer may be a single-color (e.g. monochromatic) printer. Furthermore, while the printer 1 includes the exposure units 17 that expose the photosensitive bodies 28 under control of light emission of a plurality of light-emitting elements, the printer may be a laser printer that performs exposure using a laser beam. That is, it is only necessary for the image forming apparatus to be an electrophotographic one.

What is claimed is:

1. An image forming apparatus comprising:

a carrier configured to carry developer;

a voltage applying unit configured to apply a voltage to the carrier so that a carrier current flows from the voltage applying unit through the carrier; and a current detecting unit configured to detect the carrier current, wherein the current detecting unit detects the carrier current at an uncharged portion of the carrier.

2. The image forming apparatus according to claim 1, wherein:

the carrier includes a conveying belt configured to convey a recording medium;

the voltage applying unit includes a transfer unit and a cleaning unit, wherein the transfer unit applies a transfer voltage to the conveying belt, and the cleaning unit applies a cleaning voltage to the conveying belt so as to collect developer on the conveying belt;

the cleaning unit applies a current detection voltage to the uncharged portion of the conveying belt so that a belt current flows through the conveying belt; and the current detecting unit detects the belt current.

3. The image forming apparatus according to claim 2, further comprising a determining unit, wherein:

the determining unit determines whether an opposed portion of the conveying belt to the cleaning unit is the uncharged portion; and upon determination that the opposed portion is the uncharged portion, the cleaning unit applies the current detection voltage to the conveying belt.

4. The image forming apparatus according to claim 3, wherein:

the current detecting unit detects an inflow current from the conveying belt to the cleaning unit when the cleaning unit is not applying the cleaning voltage to the conveying belt;

the determining unit determines whether the inflow current is equal to or less than a predetermined value; and upon determination of the determining unit that the inflow current is equal to or less than the predetermined value, the cleaning unit applies the current detection voltage to the conveying belt, and the current detecting unit detects the belt current.

5. The image forming apparatus according to claim 3, wherein:

the determining unit determines whether a predetermined time has elapsed, the predetermined time being a time from a time point where the transfer unit stops applying the transfer voltage to a time point where an opposed portion of the conveying belt to the transfer unit at the time point of stopping applying the transfer voltage passes a position opposed to the cleaning unit; and the current detecting unit detects the belt current after elapse of the predetermined time.

6. The image forming apparatus according to claim 5, wherein the detection of the belt current is executed during an image forming operation.

7. The image forming apparatus according to claim 2, wherein the detection of the belt current is executed when the image forming apparatus is powered on or is returned from a sleep mode.

8. The image forming apparatus according to claim 2, further comprising a charge removing unit, wherein the charge removing unit removes charge from a charged portion of the conveying belt so that the charged portion becomes the uncharged portion of the conveying belt.

9. The image forming apparatus according to claim 8, wherein:

the charge removing unit includes the cleaning unit; and the cleaning unit applies a predetermined voltage to the conveying belt so as to remove charge from the charged portion of the conveying belt.

10. The image forming apparatus according to claim 9, wherein the cleaning unit removes charge from the charged portion of the conveying belt while applying the cleaning voltage.

11. The image forming apparatus according to claim 8, wherein:

the charge removing unit includes the transfer unit; and the transfer unit applies a voltage to the conveying belt so as to remove charge from the charged portion of the conveying belt, the voltage having a polarity opposite from the transfer voltage.

12. The image forming apparatus according to claim 2, wherein:

the transfer unit includes a plurality of transfer units;

the plurality of transfer units transfer developer in respective colors to the recording medium; and the plurality of transfer units apply transfer voltages to the conveying belt corresponding to movement of the conveying belt and for a transfer period to transfer the developer in the respective colors to the recording medium.

* * * * *